US007301267B2

(12) United States Patent
Hideshima et al.

(10) Patent No.: US 7,301,267 B2
(45) Date of Patent: Nov. 27, 2007

(54) SHADOW MASK HAVING A SLOT STRUCTURE THAT PERMITS ELECTRON BEAMS TO ENTER AT INCREASED ANGLES

(75) Inventors: Hirofumi Hideshima, Tokyo-To (JP); Toshihiro Hatori, Tokyo-To (JP)

(73) Assignee: DAI Nippon Printing Co., Ltd., Tokyo (JP)

( * ) Notice: Subject to any disclaimer, the term of this patent is extended or adjusted under 35 U.S.C. 154(b) by 100 days.

(21) Appl. No.: 11/248,193

(22) Filed: Oct. 13, 2005

(65) Prior Publication Data

US 2006/0125371 A1 Jun. 15, 2006

(30) Foreign Application Priority Data

Oct. 18, 2004 (JP) ..... 2004-303434

(51) Int. Cl.
*H01J 29/07* (2006.01)

(52) U.S. Cl. ..... 313/402; 313/407

(58) Field of Classification Search ..... 313/402–407
See application file for complete search history.

(56) References Cited

U.S. PATENT DOCUMENTS

| | | | |
|---|---|---|---|
| 6,534,906 | B1 | 3/2003 | Kimura et al. |
| 6,552,482 | B2 | 4/2003 | Ito et al. |
| 6,803,710 | B1 | 10/2004 | Ikegami et al. |
| 2001/0008359 | A1 | 7/2001 | Ohmae et al. |
| 2002/0011788 | A1 | 1/2002 | Ohmae et al. |
| 2004/0027044 | A1 | 2/2004 | Hideshima et al. |

FOREIGN PATENT DOCUMENTS

| | | | |
|---|---|---|---|
| EP | 0 715 331 | A2 | 6/1996 |
| EP | 0 982 755 | A2 | 3/2000 |
| EP | 1 111 649 | A2 | 6/2001 |
| EP | 1 117 120 | A2 | 7/2001 |
| JP | A-1-320738 | | 12/1989 |
| JP | A 5-6741 | | 1/1993 |
| JP | U 61-177353 | | 11/1996 |
| JP | A 2001-68019 | | 3/2001 |
| JP | A 2002-8552 | | 1/2002 |
| KR | 1984-0002184 | B1 | 11/1984 |
| KR | 2002-0011101 | | 2/2002 |

OTHER PUBLICATIONS

U.S. App. No. 11/246,529, filed Oct. 11, 2005, Hideshima et al.
U.S. Appl. No. 11/246,532, filed Oct. 11, 2005, Hideshima et al.

*Primary Examiner*—Joseph Williams
(74) *Attorney, Agent, or Firm*—Oliff & Berridge, PLC

(57) ABSTRACT

In a shadow mask 1 of pressing type, a large number of slots are made in a mask body in the horizontal direction and in the vertical direction. Each slot has a roughly rectangular backside opening, a roughly rectangular front-side opening, and a through-hole that connects these two openings. Between each slot of the multiple slots made in the mask body that is situated at least on either of the two diagonal axes of the mask body but in such a position that the angle at which electron beams enter the slot is 20 degrees or more and another slot that is arranged adjacently to the above slot in the vertical direction, a connecting part connecting the peripheral-side vertical outer edges of the front-side openings of these slots is provided so that it runs through a horizontal bridge part formed between the front-side openings of the slots.

7 Claims, 8 Drawing Sheets

SHADOW MASK HAVING A SLOT STRUCTURE THAT PERMITS ELECTRON BEAMS TO ENTER AT INCREASED ANGLES

BACKGROUND OF THE INVENTION

1. Field of the Invention

The present invention relates to a shadow mask for forming roughly rectangular beam spots on a fluorescent screen of a color cathode ray tube.

2. Background Art

As shown in FIG. 14, a shadow mask 1 is mounted in a color cathode ray tube 101 with its surface facing to a fluorescent screen 102 of the color cathode ray tube 101. In the color cathode ray tube 101, electron beams 105 emitted from electron guns 103, deflected by the magnetic fields produced by a deflection yoke 104, pass through the shadow mask 1 and then accurately strike predetermined points on the fluorescent screen 102. Usually used for such a shadow mask 1 is a pressing-type shadow mask that is shaped by pressing, or a tension-type shadow mask that is stretched in the vertical direction (toward the upward and downward) before use.

The shadow mask 1 will be described in detail with reference to FIG. 1 (that shows the present invention). FIG. 1 is a diagrammatic plane view illustrating the positional relationship between the slots made in the shadow mask 1. As shown in this figure, the shadow mask 1 comprises a mask body 1*a* that is roughly rectangular in shape, and a large number of slots 2 (including slots 2*a*, 2*b*, 2*c*, and 2*d*) are arranged in the horizontal direction X and in the vertical direction Y on this mask body 1*a* plane, each slot having a roughly rectangular through-hole that penetrates the mask body 1*a* in the direction of thickness. In this Specification, a unit structure composed of a through-hole, and a front-side opening and a backside opening that form the through-hole is referred to as a "slot". Further, in FIG. 1, reference numeral 6 denotes a center (also referred to as a "center point") that is the intersection of two diagonal axes 5, 5 connecting the opposite corners of the mask body 1*a*, extending along the mask body 1*a* plane; reference numeral 3, a horizontal axis passing through the center 6, extending in the horizontal direction X along the mask body 1*a* plane; and reference numeral 4, a vertical axis passing through the center 6, extending in the vertical direction Y along the mask body 1*a* plane. Furthermore, in FIG. 1, reference numeral 2*a* denotes a slot situated in the center 6 of the mask body 1*a* (see character a); reference numeral 2*b*, slots situated in the outer end parts of the vertical axis 4 (see characters b, b'); reference numeral 2*c*, slots situated in the outer end parts of the horizontal axis 3 (see characters c, c'); and reference numeral 2*d*, slots situated in the outer end parts of the diagonal axes 5 (see characters d, d', e, e'). Reference numeral 1*b* denotes a skirt part that surrounds the mask body 1*a* and will be bent by pressing. FIG. 1 is merely a diagrammatic view, and the slots shown in this figure are dimensionally exaggerated.

When such a shadow mask 1 is placed in the color cathode ray tube 101 shown in FIG. 14 with the surface of the shadow mask 1 facing to the fluorescent screen 102 of the color cathode ray tube 101, the electron beams 105 emitted from the electron guns 103 vertically enter the slot 2*a* situated in the center of the shadow mask 1 but obliquely enter, at angles θ, the slots 2*b*, 2*c*, and 2*d* that are situated in the outer end parts of the respective axes (the horizontal axis 3, the vertical axis 4, and the diagonal axes 5), that is, in the peripheral part of the shadow mask 1. For this reason, in the shadow mask 1, the positions of the front-side opening and the backside opening that form a slot are adjusted according to the position of the slot in the mask body.

FIGS. 11A, 11B, 11C and 11D are diagrammatical plane views showing the shape of the slots 2 (slots 2*a*, 2*b*, 2*c* and 2*d*) made in the respective parts of the mask body 1*a* of the shadow mask 1. In these figures, reference numeral 11 denotes through-holes of the slots 2. The through-holes 11 are made so that they connect the front-side openings 12 and the backside openings 13 that are etched in a thin metal sheet. The backside openings 13 are made on the side on which electron beams 7 are incident, and the front-side openings 12 are made on the side from which the electron beams 7 emerge. The backside openings 13 and the front-side openings 12 are made roughly rectangular in shape, and the front-side openings 12 are made large in area so that they do not obstruct the passage of the electron beams 7.

Since electron beams enter, from the front, the slot 2*a* situated in the center of the mask body 1*a*, the through-hole 11 (the backside opening 13) of this slot is made so that it is positioned almost in the center of the front-side opening 12, as shown in FIG. 11A. FIG. 11B shows the slot 2*b* situated in the outer end part of the vertical axis 4; FIG. 11C, the slot 2*c* situated in the outer end part of the horizontal axis 3; and FIG. 11D, the slot 2*d* situated in the outer end part of the diagonal axis 5. Electron beams 7 obliquely enter the slots 2*b*, 2*c*, and 2*d* that are situated in the peripheral part of the mask body 1*a*. Therefore, in order not to obstruct the passage of the electron beams 7 that have passed through the through-hole 11 of each slot 2, the front-side opening 12 is made so that its position is offset from the position of the through-hole 11 (the backside opening 13) to the peripheral side in the mask body 1*a* plane.

However, even when the offset arrangement as shown in FIGS. 11A, 11B, 11C and 11D (such an arrangement that the position of the front-side opening 12 of a slot 2 is offset from the position of the through-hole 11 (the backside opening 13) of the slot 2 according to the position of the slot 2 in the mask body 1*a*) is made, of the slots 2*b*, 2*c* and 2*d* made in the peripheral part of the mask body 1*a*, especially the slots 2*d* situated in the outer end parts of the diagonal axes 5 have the shortcoming that, since electron beams 7 that have obliquely entered the slots 2*d* are partially blocked by the front-side openings 12 and the backside openings 13 of these slots, the slots 2*d* cannot let the electron beams 7 strike the fluorescent screen of the cathode ray tube to form thereon beam spots in the desired shape.

In order to overcome this problem, shadow masks having such a structure that, of the two long sides of a roughly rectangular through-hole of each slot made in a mask body, the long side situated on the side apart from the center of the mask body has a protrudent part protruding, in the direction opposite to the vertical axis of the mask body, from at least one of the upper and lower end parts of this long side, have been proposed in Japanese Laid-Open Patent Publications No. 320738/1989 and No. 6741/1993.

FIG. 12 is a front view showing the shape of the slots in the conventional shadow mask described in Japanese Laid-Open Patent Publication No. 6741/1993. The shape of the slot 2*d* shown in this figure corresponds to that of the slots situated in the upper-right outer end part of the diagonal axis 5 extending toward the upper right in the plane view of the mask body 1*a* (FIG. 1). This slot 2*d* has the following features: the position of the front-side opening 12 is offset from the position of the through-hole 11 (the backside opening 13) to the upper right, that is, to the peripheral side, and, at the same time, of the two long sides of the through-hole 11, the long side situated on the right side, that is, on the peripheral side, has a protrudent part 11*a* protruding toward the peripheral side from the lower end part of this long side. The protrudent parts 11*a* are provided for the purpose of forming roughly rectangular beam spots on a fluorescent screen of a cathode ray tube. Further, the front-side opening 12 of each slot 2*d* is made so that it has a roughly rectangular outline composed of a pair of left- and right-hand long sides 12*a*, 12*b* and a pair of upper and lower short sides 12*c*, 12*d*.

Incidentally, cathode ray tubes have came to be made flat in recent years, like the flat-type color cathode ray tube shown in FIG. 14. In such a flat-type color cathode ray tube, therefore, the angles θ at which electron beams 7 enter the slots 2 made in the shadow mask 1, especially those slots 2 situated in the peripheral part of the shadow mask 1, have come to be significantly great, and such a phenomenon that electron beams 7 that have passed through the through-holes 11 of the slots 2 are partially blocked by the sidewalls of the front-side openings 12 of the slots 2 occurs. For example, as shown in FIG. 12, although an electron beam 7*a* that has passed through the lower part of the through-hole 11 of the slot 2*d* situated in the outer end part of the diagonal axis 5 emerges from the slot 2*d* without striking the front-side opening 12 of this slot, electron beams 7*b*, 7*c* that have passed through the upper part of the through-hole 11 of the slot 2*d* are partially blocked by the sidewall of the front-side opening 12 of this slot at a site encircled by the dotted line 8.

FIG. 13 is a sectional view taken along line XIII-XIII in FIG. 12 for explaining the above-described phenomenon. As shown in this figure, the front-side opening 12 of the slot 2*d* is composed of sidewalls 14, 15, the backside opening 13 of the slot 2*d* is composed of sidewalls 16, 17, and the through-hole 11 connects the front-side opening 12 and the backside opening 13. As shown in FIG. 13, in such a slot 2*d*, when electron beams 7*b*, 7*c* that have passed through the upper part of the through-hole 11 pass through the front-side opening 12, a part of these electron beams 7*b*, 7*c* strikes the peripheral-side sidewall 15 of the front-side opening 12 and is thus blocked by this sidewall 15 at a site encircled by the dotted line 8 shown in FIG. 12. This phenomenon significantly occurs in the slots 2*d* situated, on the diagonal axes 5 passing through the center 6 of the mask body 1*a*, in such positions that the angles at which electron beams enter the slots 2*d* are 20 degrees or more, and causes the following problems: the electron beams 7*b*, 7*c* that have passed through the slots 2*d* get defective; the luminance is lowered; and the electron beams 7 cannot strike a fluorescent screen of a cathode ray tube to form thereon roughly rectangular beam spots in the desired size and shape.

SUMMARY OF THE INVENTION

The present invention was accomplished in the light of the aforementioned problems in the prior art. An object of the present invention is, therefore, to provide a shadow mask having a slot structure that can, as much as possible, prevent electron beams that have passed through the through-holes of slots from being blocked by the front-side openings of the slots even when the electron beams enter the slots at increased angles.

The present invention provides, as a first means of fulfilling the above-described object of the present invention, a shadow mask that comprises a mask body in which a large number of slots are made in the horizontal and vertical directions, and that allows electron beams to form roughly rectangular beam spots on a fluorescent screen of a cathode ray tube, each one of the slots made in the mask body having a roughly rectangular backside opening on the side on which electron beams are incident, a roughly rectangular front-side opening on the side from which electron beams emerge, and a through-hole that connects the backside opening and the front-side opening with each other, the mask body having a center point situated in the center of the mask body plane, a horizontal axis passing through the center of the mask body, horizontally extending along the mask body plane, a vertical axis passing through the center of the mask body, vertically extending along the mask body plane, and two diagonal axes passing through the center of the mask body, diagonally extending along the mask body plane, a horizontal bridge part extending in the horizontal direction being provided between the front-side openings of each two slots, of the multiple slots made in the mask body, that are arranged adjacently to each other in the vertical direction, and between each slot, of the multiple slots made in the mask body, that is situated at least on either of the diagonal axes of the mask body but in such a position that the angle at which electron beams enter the slot is 20 degrees or more and another slot that is arranged adjacently to the above slot in the vertical direction, a connecting part connecting the peripheral-side vertical outer edges of the front-side openings of these slots being provided so that it runs through the horizontal bridge part formed between the front-side openings of the slots, the connecting part being formed along and inward, to the center side, from the vertical line connecting the peripheral-side vertical outer edges of the front-side openings of the slots to be connected by the connecting part so that the relationship $0<D1<T$ is fulfilled, where T (μm) is the distance between the peripheral-side vertical outer edges of the front side openings and the peripheral-side vertical outer edges of the through-holes of the slots to be connected by the connecting part, and D1 (μm) is the horizontal width of the connecting part.

In the above-described first means of fulfilling the object of the present invention, it is preferable that a vertical bridge part extending in the vertical direction be provided between the front-side openings of each two slots, of the multiple slots made in the mask body, that are arranged adjacently to each other in the horizontal direction, and that the connecting part has an extended part extending in the horizontal direction toward the peripheral side so that the vertical bridge part recedes in the horizontal direction to the peripheral side relative to the peripheral-side vertical outer edges of the front-side openings of the slots to be connected by the connecting part. In this case, it is preferable that the connecting part fulfills the following relationship:

$$50\ \mu m<[D1+D2]<[T+50]\ \mu m$$

where T and D1 are as defined above, and D2 (μm) is the horizontal width of the extended part.

Further, in the above-described first means of fulfilling the object of the invention, it is preferable that the shadow mask is a pressing-type shadow mask that is shaped by pressing.

The present invention provides, as a second means of fulfilling the above-described object of the present invention, a shadow mask that comprises a mask body in which a large number of slots are made in the horizontal and vertical directions, and that allows electron beams to form roughly rectangular beam spots on a fluorescent screen of a cathode ray tube, each one of the slots made in the mask body having a roughly rectangular backside opening made on the side on which electron beams are incident, a vertically-extending front-side opening in the shape of a groove made on the side from which electron beams emerge, and a through-hole that connects the backside opening and the front-side opening with each other, the mask body having a center point situated in the center of the mask body plane, a horizontal axis passing through the center of the mask body, horizontally extending along the mask body plane, a vertical axis passing through the center of the mask body, vertically extending along the mask body plane, and two diagonal axes passing through the center of the mask body, diagonally extending along the mask body plane, a vertical bridge part extending in the vertical direction being provided between the front-side openings of each two slots, of the multiple slots made in the mask body, that are arranged adjacently to each other in the horizontal direction, and between each slot, of the multiple slots made in the mask body, that is situated at least on either of the diagonal axes of the mask body but in such a position that the angle at which electron beams enter the slot is 20 degrees or more and another slot that is arranged adjacently to the above slot in the vertical direction, an extended part extending in the horizontal direction toward the peripheral side being provided so that the vertical bridge part recedes in the horizontal direction to the peripheral side relative to the peripheral-side vertical outer edges of the front-side openings of the slots.

In the above-described second means of fulfilling the object of the present invention, it is preferable that the extended part fulfills the following relationship:

$$0<D3<[T1-50]\ \mu m$$

where D3 (μm) is the horizontal width of the extended part, and T1 (μm) is the distance between the peripheral-side vertical outer edge of the front-side opening, and the center-side vertical outer edge of the front-side opening of the slot situated horizontally adjacently to the slot having the base front-side opening, on its peripheral side.

Further, in the above-described second means of fulfilling the object of the invention, it is preferable that the shadow mask is a tension-type shadow mask that is stretched in the vertical direction during use.

According to the shadow mask of the first means of fulfilling the object of the present invention, between each slot situated at least on either of the diagonal axes of the mask body but in such a position that the angle at which electron beams enter the slot is 20 degrees or more and another slot that is arranged adjacently to the above slot in the vertical direction, a connecting part connecting the peripheral-side vertical outer edges of the front-side openings of these slots is provided, and this connecting part is formed along and inward, to the center side, from the vertical line connecting the above-described vertical outer edges of the front-side openings so that the relationship $0<D1<T$ is fulfilled, where T (μm) is the distance between the peripheral-side vertical outer edges of the front side openings and the peripheral-side vertical outer edges of the through-holes of the slots to be connected by the connecting part, and D1 (μm) is the horizontal width of the connecting part. Therefore, the shadow mask can prevent, to the utmost, electron beams that have obliquely passed through the through-holes of the slots, from being partially blocked by the sidewalls of the slots at sites between the slots arranged adjacently to each other in the vertical direction. Consequently, the shadow mask can let the electron beams strike a fluorescent screen of a cathode ray tube to form thereon beam spots in the desired size and shape.

Further, according to the shadow mask of the first means of fulfilling the object of the invention, the horizontal width of the connecting part is smaller than the distance T between the peripheral-side vertical outer edges of the front-side openings and the peripheral-side vertical outer edges of the through-holes, so that a non-etched bridge part is present between the front-side openings (between the through-holes) of each two slots that are arranged adjacently to each other in the vertical direction. The shadow mask having such a structure can prevent, to the utmost, electron beams from being partially blocked, and, moreover, the mask body of such a shadow mask can maintain its strength. It is, therefore, possible to conduct pressing in the production process without causing any trouble, and produce a pressing-type shadow mask with certainty.

Furthermore, according to the shadow mask of the first means of fulfilling the object of the invention, when each connecting part is made so that it has an extended part extending in the horizontal direction toward the peripheral side so that the vertically-extending bridge part recedes in the horizontal direction to the peripheral side relative to the peripheral-side vertical outer edges of the front-side openings, the enlargement of the area through which electron beams that have obliquely passed through the through-holes of the slots can pass without being partially blocked is achieved not only for the sidewalls of the front-side openings at sites between two slots that are arranged adjacently to each other in the vertical direction, but also for the peripheral-side sidewalls of the front-side openings (the sidewalls of the bridge parts). Consequently, the shadow mask can let electron beams strike a fluorescent screen of a cathode ray tube to form thereon beam spots in the desired size and shape, while maintaining the luminance high. In this case, especially when the horizontal width of the connecting part with the extended part [D1+D2] (where D2 (μm) is the horizontal width of the extended part) is made so that the relationship $50\ \mu m<[D1+D2]<[T+50]\ \mu m$ is fulfilled, it is possible to increase the area through which electron beams that have obliquely passed through the through-holes of the slots can pass without being partially blocked, while retaining the strength of the mask body.

According to the shadow mask of the second means of fulfilling the object of the present invention, between each slot situated at least on either of the diagonal axes of the mask body but in such a position that the angle at which electron beams enter the slot is 20 degrees or more and another slot that is arranged adjacently to the above slot in the vertical direction, an extended part extending in the horizontal direction toward the peripheral side is provided so that the vertical bridge part recedes in the horizontal direction to the peripheral side relative to the peripheral-side vertical outer edges of the front-side openings of the slots. Therefore, the shadow mask can prevent, to the utmost, electron beams that have obliquely passed through the through-holes of the slots. Consequently, the shadow mask can let the electron beams strike a fluorescent screen of a cathode ray tube to form thereon beam spots in the desired size and shape, while maintaining the luminance high.

The shadow masks according to the first and second means of fulfilling the object of the present invention have the above-described connecting parts and extended parts in the shape of grooves made by an etching process, so that they have increased surface areas. Consequently, these shadow masks can show the effect of reducing the occurrence of doming patterns (such a phenomenon that a shadow mask is deformed to be uneven in color due to heat generated by electron beams) and are, therefore, preferably used for flat-type cathode ray tubes of great deflection angle type, which are readily affected by doming patterns.

DETAILED DESCRIPTION OF PREFERRED EMBODIMENTS

Embodiments of the present invention will be described with reference to the accompanying drawings. The present invention is not limited to the following embodiments and encompasses a variety of other embodiments that are within the technical concept of the present invention.

First Embodiment

First of all, the entire structure of a shadow mask according to the first embodiment of the present invention will be described with reference to FIG. 1. The shadow mask according to the first embodiment of the present invention is a pressing-type shadow mask that is shaped by pressing.

Figure 1:
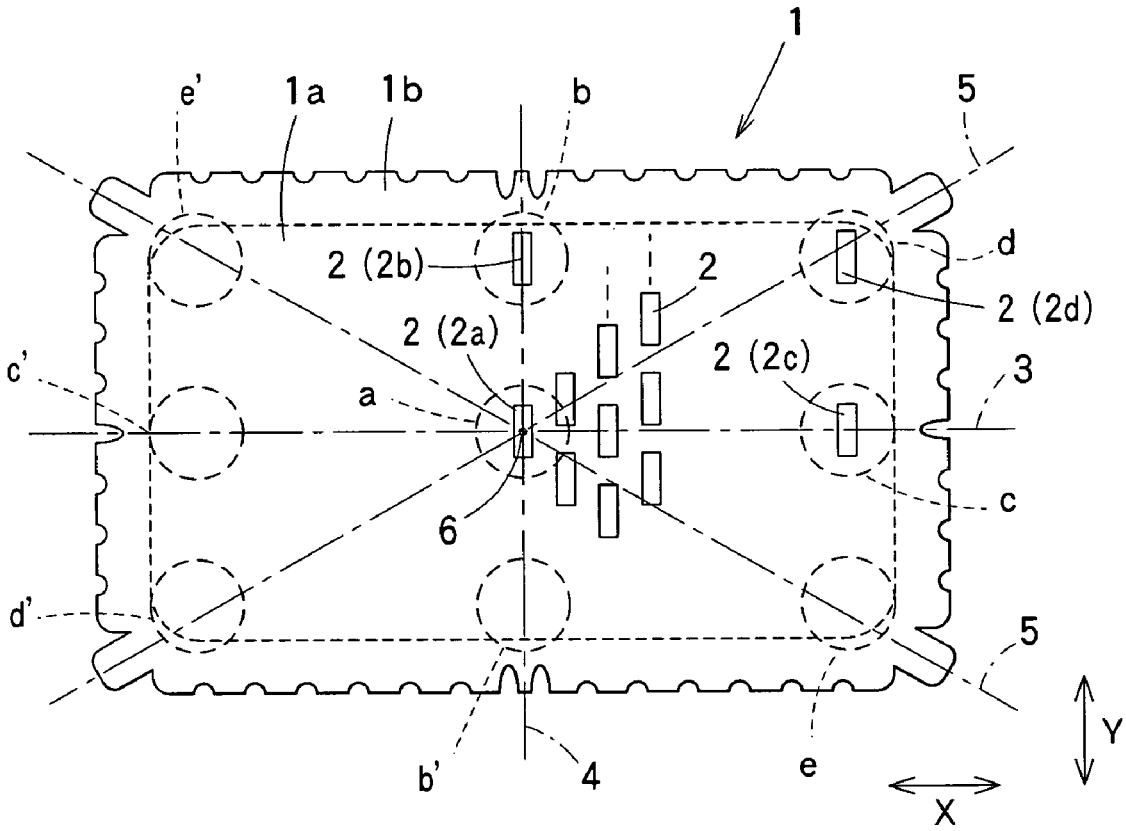
FIG. 1 is a plane view showing a shadow mask according to the first embodiment of the present invention (a diagrammatic plane view illustrating the positional relationship between the slots made in a shadow mask)

As shown in FIG. 1, a shadow mask 1 according to the first embodiment of the present invention comprises a mask body 1*a* that is roughly rectangular in shape, and this mask body 1*a* has a large number of slots 2 (including slots 2*a*, 2*b*, 2*c*, and 2*d*) with roughly rectangular through-holes penetrating the mask body 1*a* in the direction of thickness. The multiple slots 2 are arranged, in the above-described positional relationship, in the horizontal direction X and in the vertical direction Y on the mask body 1*a* plane. When mounted in a cathode ray tube, such a shadow mask 1 acts not only to shield electromagnetic waves but also to let electron beams strike a fluorescent screen of the cathode ray tube to form thereon roughly rectangular beam spots. In FIG. 1, reference numeral 6 denotes a center (also referred to as a "center point") that is the intersection of two diagonal axes 5, 5 connecting the opposite corners of the mask body 1*a*, extending along the mask body 1*a* plane; reference numeral 3, a horizontal axis passing through the center 6, extending along the mask body 1*a* plane; and reference numeral 4, a vertical axis passing through the center 6, extending along the mask body 1*a* plane. Further, in FIG. 1, reference numeral 2*a* denotes a slot situated at the center point 6 of the mask body 1*a* (see character a); reference numeral 2*b*, slots situated in the outer end parts of the vertical axis 4 (see characters b, b'); reference numeral 2*c*, slots situated in the outer end parts of the horizontal axis 3 (see characters c, c'); and reference numeral 2*d*, slots situated in the outer end parts of the diagonal axes 5 (see characters d, d', e, e'). Reference numeral 1*a* denotes a skirt part that surrounds the mask body 1*a* and will be bent by pressing.

Figure 2:
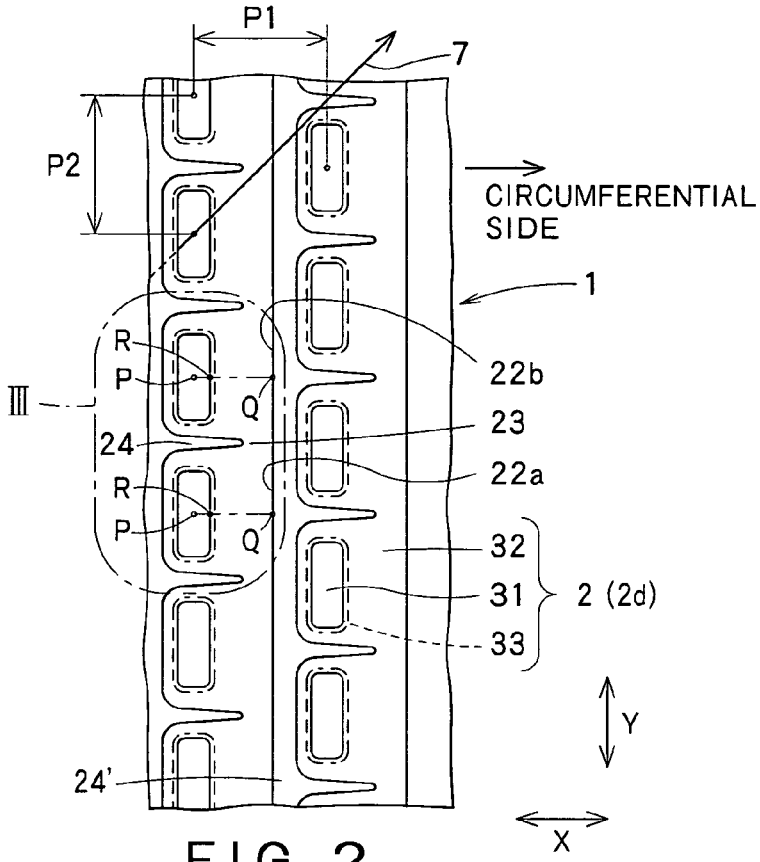
FIG. 2 is a plane view showing a part of the structure of the slots made in the outer end part of the diagonal axis of the shadow mask shown in FIG. 1.
Figure 3:
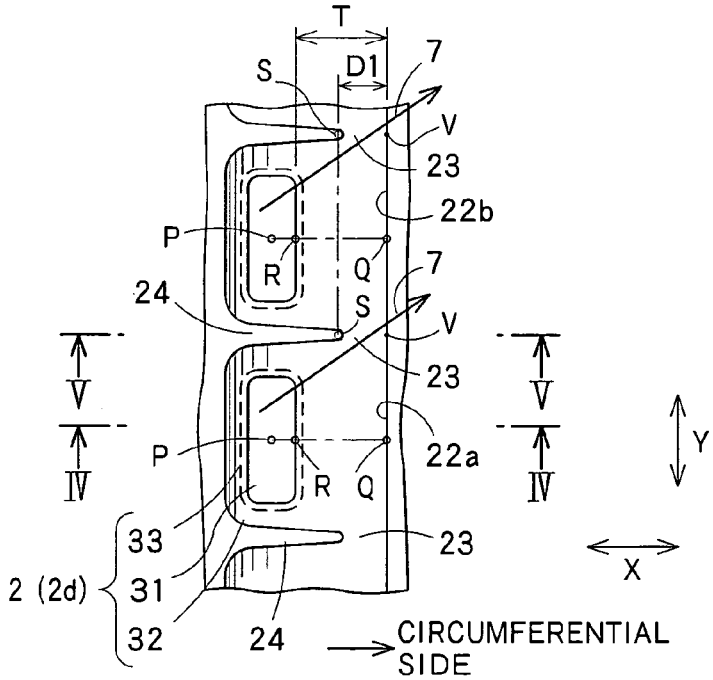
FIG. 3 is an enlarged plane view of part III shown in FIG. 2.
Figure 4:
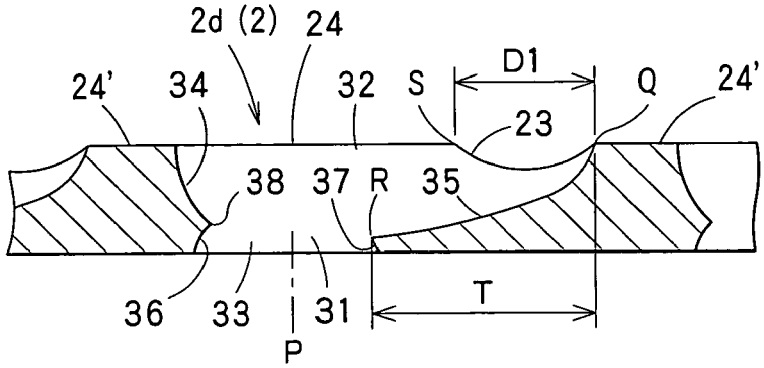
FIG. 4 is a sectional view taken along line IV-IV in FIG. 3.

FIGS. 2 and 3 are views showing a part of the structure of the slots that are made in the outer end part of the diagonal axis 5 of the shadow mask 1 shown in FIG. 1. As shown in these figures, the slots 2 are etched in a thin metal sheet made from Invar or the like, and through-holes 31 are made so that they connect front-side openings 32 and backside opening 33 that are etched in the metal sheet. The backside openings 33 of the slots 2 are made on the side on which electron beams 7 are incident, and the front-side openings 32 of the slots 2 are made on the side from which electron beams emerge. These backside openings 33 and front-side openings 32 are made roughly rectangular in shape. As shown in FIG. 4, the front-side opening 32 of each slot 2 is composed of sidewalls 34, 35, and is made to have a large area so that it does not obstruct the passage of electron beams that emerge from the slot 2. Further, a narrow bridge part (horizontal bridge part) 24 remaining after the etching step is present between the front-side openings 32 of each two slots 2, 2 that are arranged adjacently to each other in the vertical direction Y, that is, the slots 2, 2 are arranged in the vertical direction Y with the bridge part 24 between them. Furthermore, a non-etched bridge part (vertical bride part) 24' remaining after the etching step is present between the front-side openings 32 of the slots 2, 2 that are arranged adjacently to each other in the horizontal direction X.

The front-side openings 32 of the slots 2 vary in position relative to the through-hole 31 (the backside opening 33), depending on the position of the slot 2 in the mask body 1*a*. Namely, in the slot 2*a* situated in the center 6 of the mask body 1*a*, the front-side opening 32 is made so that the through-hole 31 (the backside opening 33) is positioned in its center. On the other hand, the slots 2*c* situated in the outer end parts of the horizontal axis 3 are made so that the position of the front-side opening 32 is gradually offset from the position of the through-hole 31 (the backside opening 33) to the peripheral side as the position of the slot 2*c* gets apart from the center 6. Similarly, the slots 2*b* situated in the outer end parts of the vertical axis 4 are made so that the position of the front-side opening 32 is gradually offset from the position of the through-hole 31 (the backside opening 33) to the peripheral side as the position of the slot 2*b* gets apart from the center 6.

Figure 14:
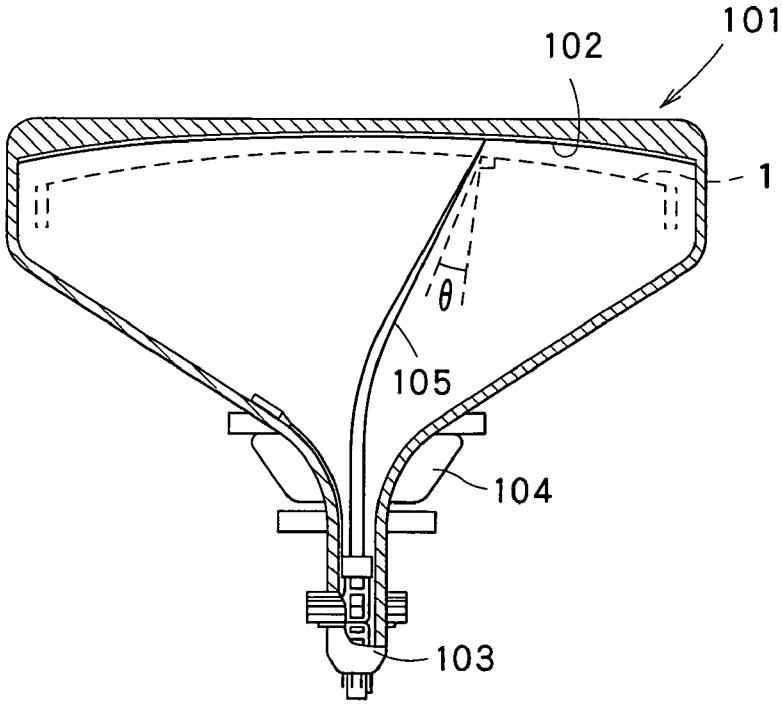
FIG. 14 is a sectional view showing the basic structure of a flat-type color cathode ray tube in which a shadow mask is incorporated.

The above description is applicable also to the slots 2*d* that are situated on or along the diagonal axes 5, 5; that is, these slots 2*d* are made so that the position of the front-side opening 32 is gradually offset from the position of the through-hole 31 (the backside opening 33) to the peripheral side as the position of the slot 2*d* gets apart from the center 6. For example, as shown in the plane view (FIG. 1) of the mask body 1*a*, the slots 2 on the diagonal axis 5 extending toward the upper right are made so that the position of the front-side opening 32 is gradually offset from the position of the through-hole 31 (the backside opening 33) to the right-hand side and upward (that is, to the upper right) as the position of the slot 2 gets apart from the center 6 toward the upper right, while that the position of the front-side opening 32 is gradually offset from the position of the through-hole 31 (the backside opening 33) to the left-hand side and downward (that is, to the lower left) as the position of the slot 2 gets apart from the center 6 toward the lower left. The same is true for those slots 2 situated on the other diagonal axis 5 extending toward the lower right. The degree of the offset varies according to the angle θ at which electron beams 7 obliquely enter the slot 2 (see FIG. 14), and is determined so that electron beams 7 that have passed through the through-holes 31 are not partially blocked by the sidewalls (see reference numeral 35 in FIG. 4) of the front-side openings 32.

In the shadow mask 1 according to the first embodiment of the present invention, between each slot 2*d*, of the multiple slots 2 made in the mask body 1*a*, that is situated at least on either of the diagonal axes 5 of the mask body 1*a* but in such a position that the angle θ at which electron beams 7 enter the slot 2*d* is 20 degrees or more and another slot 2*d* that is situated adjacently to the above slot 2*d* in the vertical direction, a connecting part 23 connecting the peripheral-side vertical outer edges 22*a*, 22*b* of the front-side openings 32, 32 of these slots 2*d* is provided, as shown in FIGS. 2 and 3. This connecting part 23 is formed so that it runs through the bridge part 24 existing between the front-side openings 32 of each two slots 2, 2 that are arranged adjacently to each other in the vertical direction Y.

The connecting part 23 is formed along and inward, to the center side, from the vertical line connecting the peripheral-side vertical outer edges 22*a*, 22*b* of the front-side openings 32, 32 that are arranged adjacently to each other in the vertical direction, as shown in FIG. 3. In FIG. 3, character P denotes the slot center of the through-hole 31 of the slot 2*d*; character Q, the intersection of the line horizontally drawn from the slot center P of the slot 2*d* and the peripheral-side vertical outer edge of the front-side opening of the slot 2*d*; and character R, the intersection of the line horizontally drawn from the slot center P of the slot 2*d* and the peripheral-side vertical outer edge of the through-hole 31. As shown in this figure, the connecting part 23 fulfills the relationship $0<D1<T$, where T (μm) is the distance between the points Q and R, and D1 (μm) is the width, in the horizontal direction X, of the connecting part 23. The horizontal width D1 (μm) of the connecting part 23 is the distance between the peripheral-side end S of the bridge part 24 present between the two slots 2*d* that are arranged adjacently to each other in the vertical direction and the peripheral-side vertical outer edge of the front-side opening 32. This distance is given as the distance between the above-described peripheral-side end S and the intersection V of the line drawn in the horizontal direction from the peripheral-side end S and the peripheral-side vertical outer edge of the front-side opening 32.

The connecting part 23 is formed by partially etching the peripheral part of the bridge part 24 remaining, after the etching step, between the front-side openings 32 of each two slots 2*d* that are arranged adjacently to each other in the vertical direction. The step of partially etching the bridge parts 24 is conducted simultaneously with the etching step for making the slots 2.

Figure 12:
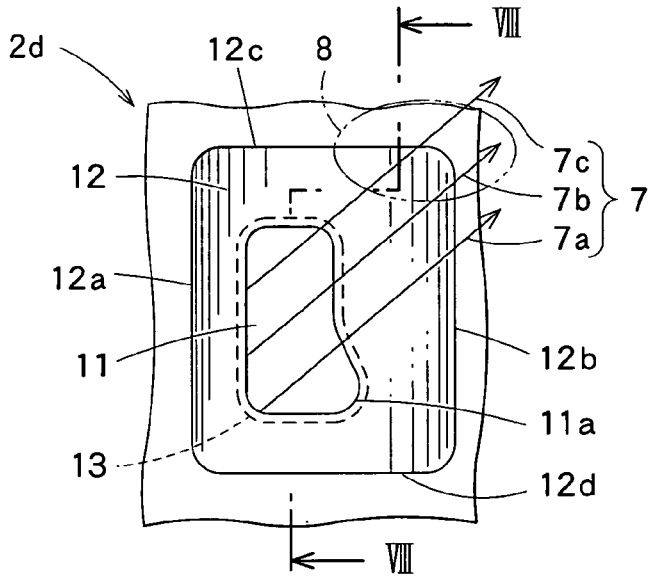
FIG. 12 is a plane view showing the shape of slots in a conventional shadow mask.
Figure 13:
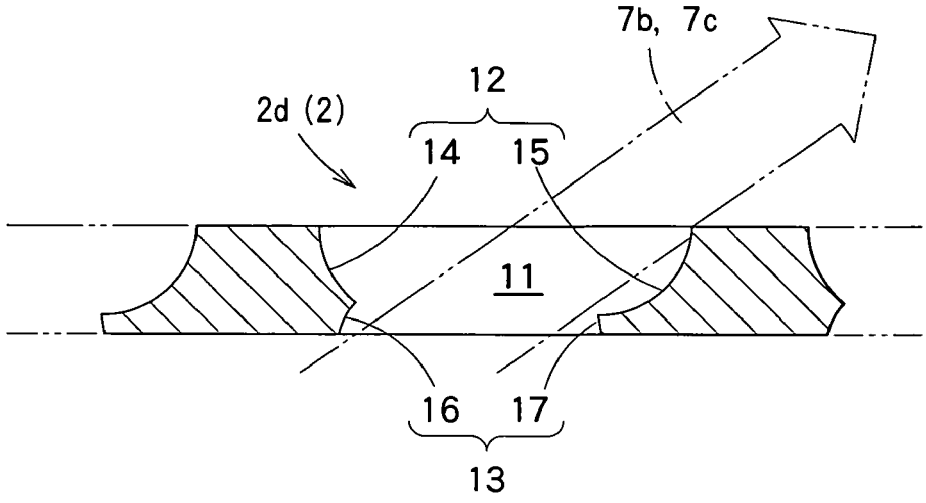
FIG. 13 is a sectional view taken along line XIII-XIII in FIG. 12, showing the behavior of electron beams.

Although the connecting parts 23 are formed in those slots 2 situated at least in such positions on the diagonal axes 5 that the angles θ at which electron beams 7 enter the slots 2 are 20 degrees or more, as mentioned above, they may be formed in the slots 2 situated in other positions. For example, the connecting parts 23 may be formed in the slots 2 situated in the vicinity of the above-described positions. Further, the connecting parts 23 may also be formed in the slots 2 situated outside the vertical lines passing through such points on the diagonal axes 5 that the angle θ at which electron beams enter the slots is 20 degrees, and, in an extreme case, the connecting parts 23 may be formed in all the slots 2 on the entire surface of the mask body 1*a*. However, the most effective case is that the connecting parts 23 are formed in the slots 2*d* that are made in such positions that electron beams 7 pass through obliquely, as shown in FIG. 12. The reason why the connecting parts 23 are formed in the slots 2 situated in such positions that the angles θ at which electron beams enter the slots 2 are 20 degrees or more is that it is not necessary to form the connecting parts 23 in those slots 2 situated in such positions that the angles θ at which electron beams enter the slots 2 are less than 20 degrees.

As mentioned above, the width D1, in the horizontal direction X, of the connecting part 23 fulfills the relationship $0<D1<T$. The shadow mask 1 having the connecting parts 23 fulfilling this relationship can prevent, to the utmost, electron beams 7 that have obliquely passed through the through-holes 31 of the slots 2 from being partially blocked by the sidewalls of the front-side openings 32 at sites between the slots 2 arranged adjacently to each other in the vertical direction. The reason why the width D1, in the horizontal direction X, of the connecting part 23 is made greater than 0 is that it is necessary to obtain the above-described actions and effects by forming at least the connecting parts 23. On the other hand, the reason why the width D1, in the horizontal direction X, of the connecting part 23 is made smaller than the distance T is that it is necessary to make the non-etched bridge part 24 remain, with certainty, between the front-side openings 32, 32 (between the through-holes 31, 31) of each two slots that are arranged adjacently to each other in the vertical direction Y. Since such bridge parts 24 are present even when the connecting parts 23 are formed, it is possible to retain the strength of the mask body 1*a*. If the width D1, in the horizontal direction X, of the connecting part 23 is greater than the distance T, no bridge part 24 is present between the front-side openings 32, 32 (between the through-holes 31, 31) of each two slots that are arranged adjacently to each other in the vertical direction Y. This is disadvantageous to a pressing-type shadow mask, which demands the maintenance of the strength of the mask body 1*a*.

An example of the shadow mask 1 of pressing type is specifically as follows: the slots 2 are arranged in the horizontal direction X with a pitch P1 of approximately 700 μm and in the vertical direction Y with a pitch P2 of approximately 650 μm, and the distance T is approximately 150 to 250 μm. The slot pitch P1 gradually becomes greater as the position of the slot 2 gets apart, in the horizontal direction X, from the center to the peripheral side and the angle θ (see FIG. 14) at which electron beams 7 enter the slot 2 becomes greater.

Figure 5:
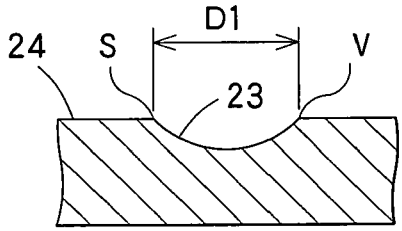
FIG. 5 is a sectional view taken along line V-V in FIG. 3.

FIGS. 4 and 5 are sectional views taken along line IV-IV and line V-V in FIG. 3, respectively. As is clear from these figures, the connecting part 23 with a width D1 is formed inward, to the center side, from the peripheral-side vertical outer edge Q of the front-side opening. The connecting part 23 has a cross section in the shape of a groove that connects two front-side openings 32 arranged in the vertical direction Y, and is made by partially etching the peripheral part of the bridge part 24. Electron beams 7 can pass through the connecting part 23 without being blocked by the sidewall 35 of the front-side opening 32.

Figure 7:
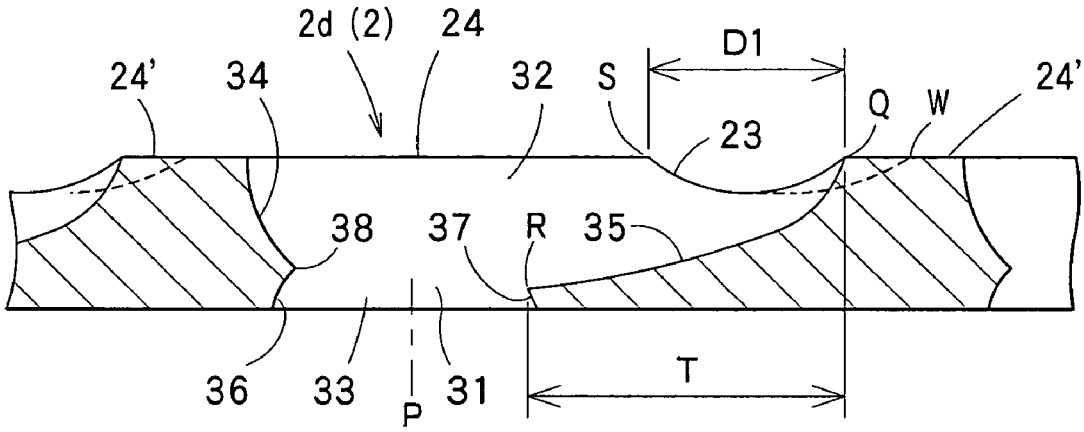
FIG. 7 is a sectional view taken along line VII-VII in FIG. 6.
Figure 8:
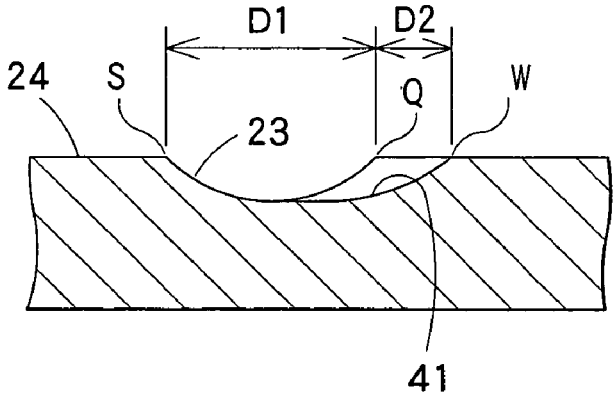
FIG. 8 is a sectional view taken along line VIII-VIII in FIG. 6.

Next, a modification of the shadow mask 1 according to the first embodiment shown in FIGS. 1 to 5 will be described hereinafter with reference to FIGS. 6 to 8.

Figure 6:
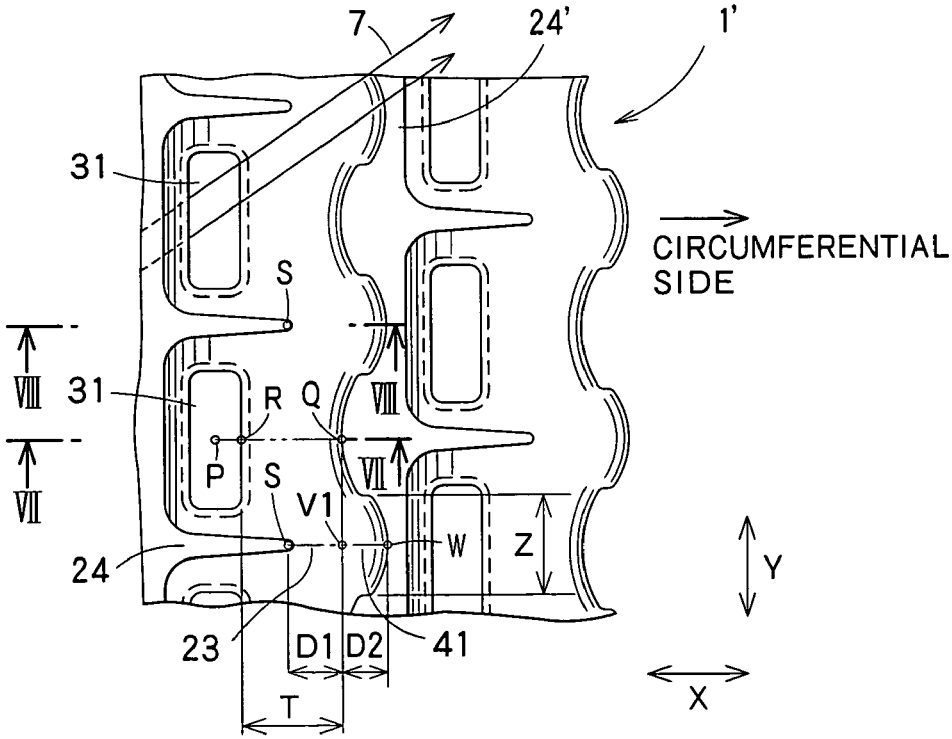
FIG. 6 is a plane view showing a modification of the shadow mask according to the first embodiment shown in FIGS. 1 to 5.

As shown in FIG. 6, in a shadow mask 1' of this embodiment, each connecting part 23 has an extended part 41 extending in the horizontal direction X toward the peripheral side so that a bridge part 24' extending in the vertical direction recedes in the horizontal direction X to the peripheral side relative to the peripheral-side vertical outer edges of the front-side openings of the slots connected by the connecting part 23.

It is preferable that the width [D1+D2] (where D2 (μm) is the width, in the horizontal direction X, of the extended part 41), in the horizontal direction X, of the connecting part 23 with the extended parts 41 fulfill the relationship 50 μm<[D1+D2]<[T+50] μm. The width [D1+D2], in the horizontal direction X, of the connecting part 23 is made more than 50 μm in order to prevent, as much as possible, electron beams 7 from being blocked by the side wall of the bridge part 24', by making the bottom of the connecting part 23 lower (i.e., by forming a deeper groove for the connecting part 23). On the other hand, the width [D1+D2], in the horizontal direction X, of the connecting part 23 is made less than [T+50 μm] in order to maintain the molding characteristics. Therefore, when the width [D1+D2], in the horizontal direction X, of the connecting part 23 is less than 50 μm, the passage of electron beams 7 can be imperfect at the connecting part 23, while when this width [D1+D2] is [T+50] μm or more, the shadow mask cannot have sufficiently high strength, which makes the molding characteristics and the results of drop test poor.

The extended part 41 with a width D2, extending in the horizontal direction X toward the peripheral side, is formed so that it extends from the peripheral-side vertical outer edge of the front-side opening, as shown in FIG. 6. The width D2 of the extended part 41 is the distance, in the horizontal direction X, between the peripheral-side vertical outer edge Q of the front-side opening and the peripheral-side outer edge W of the connecting part 23, and is made approximately 50 to 150 μm. On the other hand, the extended part 41 is formed so that it has a vertical width Z of approximately 150-400 μm.

Thus, according to the shadow masks 1, 1' of the first embodiment of the present invention, between each slot 2*d* situated at least on either of the diagonal axes 5 of the mask body 1*a* but in such a position that the angle θ at which electron beams 7 enter the slot 2*d* is 20 degrees or more and another slot 2*d* that is situated adjacently to the above slot 2*d* in the vertical direction Y, the connecting part 23 connecting the peripheral-side vertical outer edges 22*a*, 22*b* of the front-side openings 32, 32 of these slots 2*d* is provided; and this connecting part 23 is formed along and inward, to the center side, from the vertical line connecting the peripheral-side vertical outer edges 22*a*, 22*b* of the front side openings 32, 32 of the slots 2*d* to be connected by the connecting part 23 so that the relationship 0<D1<T is fulfilled, where T (μm) is the distance between the peripheral-side vertical outer edges of the front-side openings and the peripheral-side vertical outer edges of the through-holes of the slots 2*d*, and D1 (μm) is the width, in the horizontal direction X, of the connecting part 23. Therefore, the shadow masks 1, 1' can prevent, to the utmost, electron beams 7 that have obliquely passed through the through-holes 31 of the slots 2*d* from being partially blocked by the sidewalls of the front-side openings 32 at sites between the slots 2*d* that are arranged adjacently to each other in the vertical direction Y. Consequently, the shadow masks 1, 1' can let the electron beams strike on a fluorescent screen of a cathode ray tube to form thereon beam spots in the desired size and shape, while maintaining the luminance high.

Further, according to the shadow masks 1, 1' of the first embodiment of the present invention, since the width D1, in the horizontal direction X, of the connecting part 23 is smaller than the distance T between the peripheral-side vertical outer edges of the front-side openings 32 and the peripheral-side vertical outer edges of the through-holes 31, a non-etched bridge part 24 is present between the front-side openings 32, 32 (between the through-holes 31, 31) of each two slots 2, 2 that are arranged adjacently to each other in the vertical direction Y. The shadow masks 1, 1' having such a structure can therefore prevent, to the utmost, electron beams 7 from being partially blocked, and, moreover, the mask bodies 1*a* of these shadow masks 1, 1' can maintain their strength. It is, therefore, possible to conduct pressing in the production process without causing any trouble and produce a pressing-type shadow mask with certainty.

Furthermore, according to the shadow mask 1' of the first embodiment of the present invention, each connecting part 23 has the extended part 41 extending in the horizontal direction X toward the peripheral side so that the bridge part 24' extending in the vertical direction recedes in the horizontal direction X to the peripheral side relative to the peripheral-side vertical outer edges of the front-side openings of the slots connected by the connecting part 23. Therefore, not only for the sidewalls of the front-side openings 32 at sites between two slots 2*d*, 2*d* that are arranged adjacently to each other in the vertical direction Y, but also for the peripheral-side sidewalls of the front-side openings 32 (the sidewalls of the bridge parts 24'), the enlargement of the area through which electron beams 7 that have obliquely passed through the through-holes 31 of the slots 2*d* can pass without being partially blocked can be achieved. Consequently, the shadow mask 1' can let the electron beams 7 strike a fluorescent screen of a cathode ray tube to form thereon electron beams in the desired size and shape, while maintaining the luminance high. In the shadow mask 1' according to the first embodiment of the present invention, especially the width, in the horizontal direction X, of the connecting part 23 having the extended part 41 with a horizontal width D2 (μm) is made to fulfill the relationship 50 μm<[D1+D2]<[T+50] μm, so that it is possible to increase the area through which electron beams 7 that have obliquely passed through the through-holes 31 of the slots 2*d* can pass without being partially blocked, while retaining the strength of the mask body 1*a*.

Since the shadow masks 1, 1' according to the first embodiment of the present invention have the above-described connecting parts 23 and extended parts 41 in the shape of grooves that are made by an etching process, they have increased surface areas. Consequently, the shadow masks 1, 1' can show the effect of reducing the occurrence of doming patterns that takes place due to heat generated when electron beams strike the shadow mask, and are, therefore, preferably used for flat-type cathode ray tubes of great deflection angle type, which are readily affected by doming patterns.

Second Embodiment

Next, a shadow mask according to the second embodiment of the present invention will be described with reference to FIGS. 9, 10A and 10B. The shadow mask according to the second embodiment of the present invention is a so-called tension type shadow mask that is stretched in the vertical direction Y during use.

Figure 9:
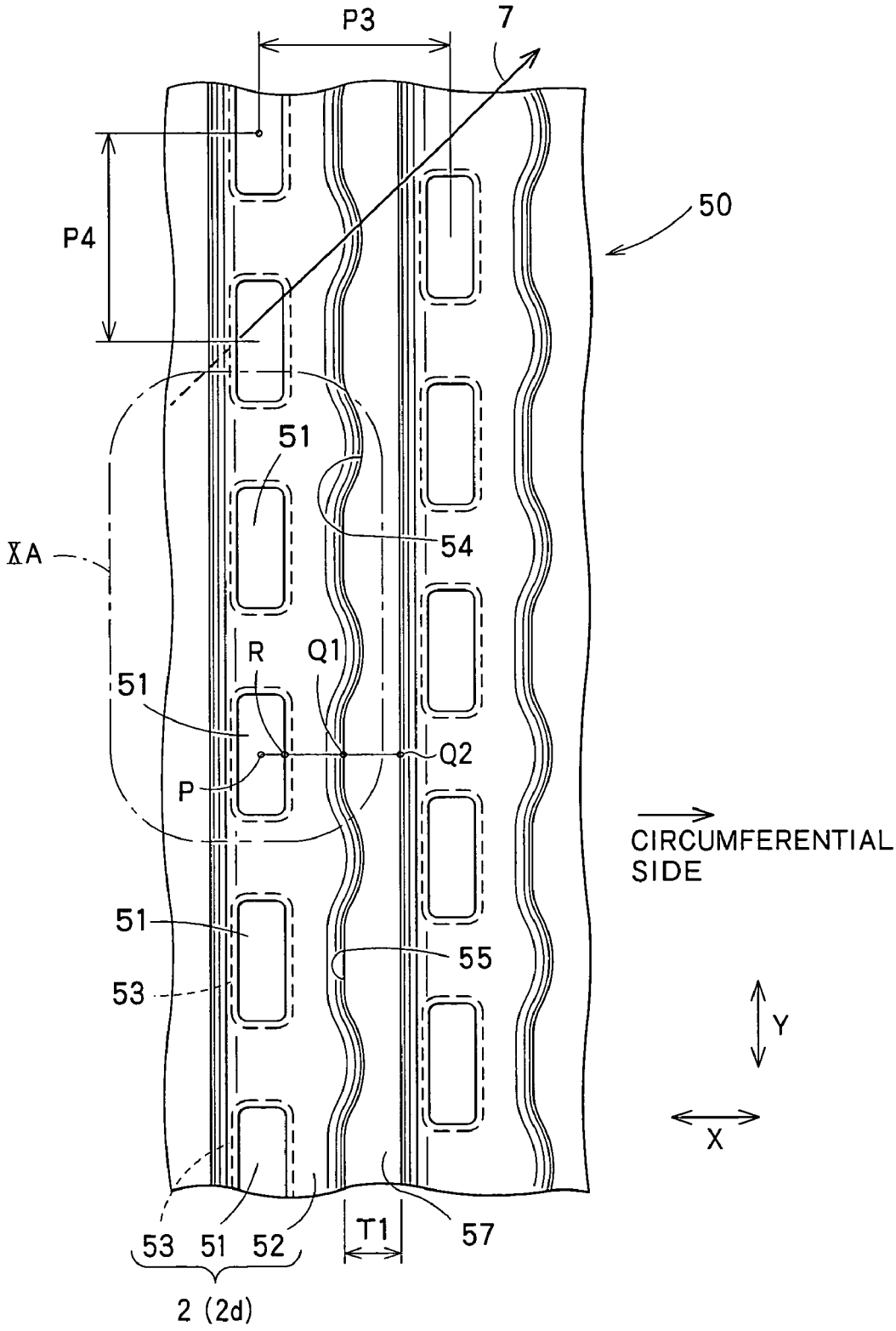
FIG. 9 is a plane view showing a part of the structure of the slots made in the outer end part of the diagonal axis of a shadow mask according to the second embodiment of the present invention.

As shown in FIG. 9, the entire structure of a shadow mask 50 according to the second embodiment of the present invention is similar to that of the shadow mask 1 shown in FIG. 1. Namely, in the shadow mask 50, a large number of slots 2 are arranged in the horizontal direction X and in the vertical direction Y on the mask body plane, each slot 2 having a roughly rectangular through-hole penetrating the mask body in the direction of thickness. The positional relationship between the slots 2 on the mask body plane is as mentioned previously, and the detailed description for this relationship will be omitted.

The slots 2 are etched in a thin metal sheet made from Invar or the like, as shown in FIG. 9, and through-holes 51 are made so that they connect front-side openings 52 and backside openings 53 that are made by an etching process. The backside openings 53 of the slots 2 are made on the side on which electron beams 7 are incident, and the front-side openings 52 of the slots 2 are made on the side from which the electron beams 7 emerge. Further, between the front-side openings 52 of each two slots, of the multiple slots, that are arranged adjacently to each other in the horizontal direction X, a non-etched bridge part (vertical bridge part) 57 remaining after the etching step is present. The backside openings 53 are made roughly rectangular. On the other hand, the front-side openings 52 are made in the shape of grooves extending in the vertical direction Y, and the peripheral-side vertical outer edges of the grooves correspond to the peripheral-side vertical outer edges 55 of the front-side openings 52.

Figure 10A:
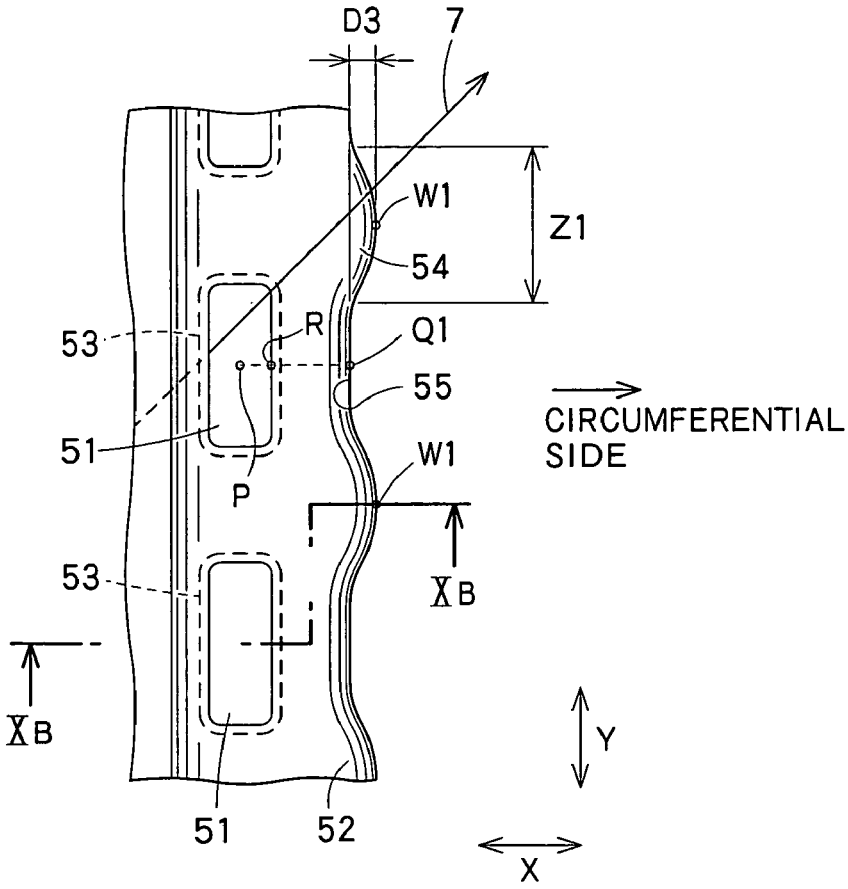
FIG. 10A is an enlarged plane view of part XA shown in FIG. 9.

In such a shadow mask 50 according to the second embodiment, between each slot 2*d*, of the multiple slots 2 made in the mask body, that is situated at least on either of the diagonal axes of the mask body but in such a position that the angle at which electron beams 7 enter the slot 2*d* is 20 degrees or more and another slot 2*d* that is arranged adjacently to the above slot 2*d* in the vertical direction Y, an extended part 54 extending in the horizontal direction X toward the peripheral side is formed so that the bridge part 57 extending in the vertical direction Y recedes in the horizontal direction X to the peripheral side relative to the peripheral-side vertical outer edge 55 of the front-side opening 52 (the outer edge Q1 of the front-side opening 52), as shown in FIGS. 9 and 10A. The extended parts 54 are formed simultaneously with the formation, by an etching process, of the front-side openings 52 in the shape of grooves extending in the vertical direction Y.

Although the extended parts 54 are formed in those slots 2 situated at least in such positions on the diagonal axes that the angles θ at which electron beams 7 enter the slots 2 are 20 degrees or more, as in the shadow mask 1' according to the aforementioned first embodiment, they may also be formed in the slots 2 situated in other positions. For example, the extended parts 54 may be formed in the slots 2 situated in the vicinity of the above-described positions. Further, the extended parts 54 may also be formed in the slots 2 situated outside the vertical lines passing through such points on the diagonal axes 5 that the angle θ at which electron beams enter the slots is 20 degrees, and, in an extreme case, the extended parts 54 may be formed in all the slots 2 on the entire surface of the mask body 1*a*. However, the most effective case is that the extended parts 54 are formed in those slots 2*d* that are made in such positions that electron beams 7 obliquely pass through the slots 2*d*, as shown in FIG. 12. The reason why the extended parts 54 are formed in the slots 2 situated in such positions that the angles θ at which electron beams enter the slots 2 are 20 degrees or more is that it is not necessary to form the extended parts 54 in those slots 2 situated in such positions that the angles θ at which electron beams enter the slots 2 are less than 20 degrees.

Further, it is preferable that the extended part 54 fulfills the relationship $0<D3<[T1-50]$ μm, where D3 is the width, in the horizontal direction X, of the extended part 54, and T1 is the distance between the peripheral-side vertical outer edge Q1 of the front-side opening 52, and the center-side vertical outer edge Q2 of the front-side opening 52 of the slot 2 that is situated horizontally adjacently to the slot having the base front-side opening 52, on its peripheral side.

Figure 10B:
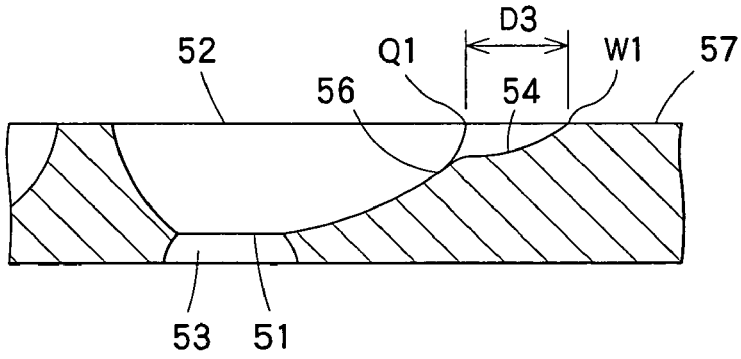
FIG. 10B is a sectional view taken along line XB-XB in FIG. 10A, FIGS. 11A, 11B, 11C and 11D are diagrammatical plane views showing the shape of the slots made in various parts of a shadow mask.
Figures 11A, 11B, 11C, 11D:
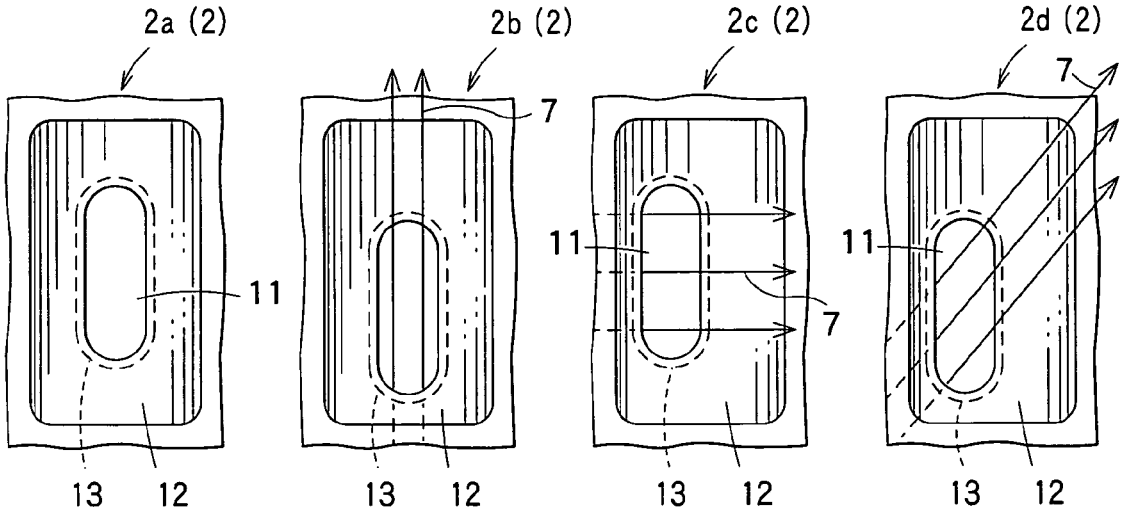

The shadow mask 50 having the extended parts 54 that fulfill the above-described relationship can prevent, to the utmost, electron beams 7 that have obliquely passed through the through-holes 51 of the slots 2 from being partially blocked by the sidewalls of the front-side openings 52 (see reference numeral 56 in FIG. 10B). The reason why the width D3, in the horizontal direction X, of the extended part 54 is made greater than 0 is that it is necessary to obtain the above-described actions and effects by forming at least the extended parts 54. On the other hand, the reason why the width D3, in the horizontal direction X, of the extended part 54 is made less than [T1−50] μm is that the shadow mask 50 cannot have sufficiently high strength when the width D3 is made equal to or more than [T1−50] μm.

An example of the shadow mask 50 of tension type is specifically as follows: the slots 2 are arranged in the horizontal direction X with a pitch P3 of approximately 700 μm and in the vertical direction Y with a pitch P4 of approximately 650 μm, and the distance T1 is approximately 50 to 300 μm. The slot pitch P3 gradually becomes greater as the position of the slot 2 gets apart, in the horizontal direction X, from the center to the peripheral side and the angle θ (see FIG. 14) at which electron beams 7 enter the slot 2 becomes greater. On the other hand, the extended parts 54 are formed so that they have a vertical width Z1 of approximately 150-400 μm.

FIG. 10B is a sectional view taken along line XB-XB in FIG. 10A. As shown in this figure, the front-side openings 52 of the slots 2 are in the shape of grooves connecting the front-side openings 52 that are arranged adjacently to each other in the vertical direction Y. As is clear from FIG. 10B, each extended part 54 has the width D3 that is the distance between the peripheral-side vertical outer edge Q1 of the front-side opening and the peripheral-side outer edge W1 of the front-side opening and is made so that it protrudes in the horizontal direction X toward the peripheral side. The extended parts 54 are formed by partially etching the peripheral parts of the bridge parts 24. Electron beams 7 can pass through the extended parts 54 without being blocked by the sidewalls 56 of the front-side openings 52.

Thus, according to the shadow mask 50 of the second embodiment of the present invention, between each slot 2*d* situated at least on either of the diagonal axes 5 of the mask body 1*a* but in such a position that the angle θ at which electron beams 7 enter the slot 2*d* is 20 degrees or more and another slot 2*d* that is arranged adjacently to the above slot 2*d* in the vertical direction Y, the extended part 54 extending in the horizontal direction X toward the peripheral side is formed so that the bridge part 57 extending in the vertical direction Y recedes in the horizontal direction X to the peripheral side relative to the peripheral-side vertical outer edges 55 (the outer edges Q1) of the front-side openings 52 of the slots 2*d*. For this reason, the shadow mask 50 can prevent, to the utmost, electron beams 7 that have obliquely passed through the through-holes 51 of the slots 2*d* from being partially blocked by the sidewalls of the front-side openings 52. Consequently, the shadow mask 50 can let the electron beams 7 strike a fluorescent screen of a cathode ray tube to form thereon electron beams in the desired size and shape, while maintaining the luminance high.

Further, since the shadow mask 50 of the second embodiment of the present invention has the above-described extended parts 54 in the shape of grooves made by an etching process, it can show the effect of reducing the occurrence of doming patterns, like the shadow masks 1, 1' according to the above-described first embodiment, and is, therefore, preferably used for a flat-type cathode ray tube of great deflection angle type, which is readily affected by doming patterns.

(Process for Producing Shadow Masks According to First and Second Embodiments)

A typical process for producing the shadow masks 1, 1', 50 according to the above-described first and second embodiments will be described hereinafter. It is needless to say that the shadow masks of the present invention are not limited to ones produced by the following manufacturing process.

It is possible to produce the shadow masks 1, 1', 50 according to the aforementioned first and second embodiments by the following conventionally known process.

Namely, to produce the shadow masks 1, 1', 50, a photoetching process using a continuous in-line system is usually employed. Specifically, for example, an aqueous colloidal photoresist or the like is applied to both surfaces of a thin metal sheet and dried. Thereafter, a photomask with a pattern of the aforementioned front-side openings 32, 52 is brought into close contact with the front surface of the metal sheet, and a photomask with a pattern of the above-described backside openings 33, 53 is brought into close contact with the back surface of the metal sheet. This one is exposed to ultraviolet light emitted from a high mercury vapor pressure lamp or the like and then developed with water. The positional relationship between the photomask with a pattern of the front-side openings 32, 52 and the photomask with a pattern of the backside openings 33, 53, and the shape of these photomasks are designed with consideration for the positional relationship between the front-side openings 32, 52 and the backside openings 33, 53 of the slots 2 in the resulting shadow masks 1, 1', 50, and the size of the openings.

The bare-metal portions of the thin metal sheet, surrounded by the resist film after development, are made into the above-described shapes by changing the etching speed. After conducting heat treatment, etc., the etching step is effected by spraying a ferric chloride solution over both surfaces of the metal sheet, for example.

Thereafter, the post-treatment steps such as rinsing with water and stripping are successively conducted. Thus, there are finally obtained the shadow masks 1, 1', 50 according to the above-described first and second embodiments.

The invention claimed is:

1. A shadow mask that comprises a mask body in which a large number of slots are made in a horizontal direction and a vertical direction, and that allows electron beams to form roughly rectangular beam spots on a fluorescent screen of a cathode ray tube, each one of the slots made in the mask body having a roughly rectangular backside opening on a side on which electron beams are incident, a roughly rectangular front-side opening on a side from which electron beams emerge, and a through-hole that connects the backside opening and the front-side opening with each other, the mask body having a center point situated in a center of a mask body plane, a horizontal axis passing through the center of the mask body, horizontally extending along the mask body plane, a vertical axis passing through the center of the mask body, vertically extending along the mask body plane, and two diagonal axes passing through the center of the mask body, diagonally extending along the mask body plane, a horizontal bridge part extending in the horizontal direction being provided between the front-side openings of each two first slots, of the slots made in the mask body, that are arranged adjacently to each other in the vertical direction, and between each second slot, of the slots made in the mask body, that is situated at least on either of the diagonal axes of the mask body but in such a position that an angle at which the electron beams enter the second slot is 20 degrees or more and a third slot that is arranged adjacently to the second slot in the vertical direction, a connecting part connecting a peripheral-side vertical outer edges of the front-side openings of the second and third slots, the connecting part being formed on a front-side of the mask body, while not affecting a back-side of the mask body so that the connecting part runs through the horizontal bridge part formed between the front-side openings of the second and third slots, the connecting part being formed along and inward, to a center side, from a vertical line connecting the peripheral-side vertical outer edges of front-side openings of the second and third slots to be connected by the connecting part so that the relationship $0<D1<T$ is fulfilled, where T (μm) is a distance between the peripheral-side vertical outer edges of the front side openings and the peripheral-side vertical outer edges of through-holes of the second and third slots to be connected by the connecting part, and D1 (μm) is a horizontal width of the connecting part.

2. The shadow mask according to claim 1, wherein a vertical bridge part extending in the vertical direction is provided between front-side openings of each two slots, of the slots made in the mask body, that are arranged adjacently to each other in the horizontal direction, and the connecting part has an extended part extending in the horizontal direction toward a peripheral side so that the vertical bridge part recedes in the horizontal direction to the peripheral side relative to the peripheral-side vertical outer edges of the front-side openings of the second and third slots to be connected by the connecting part.

3. The shadow mask according to claim 2, wherein the connecting part satisfies:

$$50\ \mu m < [D1 + D2] < [T + 50]\ \mu m,$$

where T and D1 are as defined in claim 1, and D2 (μm) is a horizontal width of the extended part.

4. The shadow mask according to claim 1 that is a pressing-type shadow mask to be shaped by pressing.

5. A shadow mask that comprises a mask body in which a large number of multiple slots are made in a horizontal direction and a vertical direction, and that allows electron beams to form roughly rectangular beam spots on a fluorescent screen of a cathode ray tube, each one of the multiple slots made in the mask body having a roughly rectangular backside opening made on a first side on which electron beams are incident, a vertically-extending front-side opening in a shape of a groove made on a second side from which electron beams emerge, and a through-hole that connects the backside opening and the front-side opening with each other, the mask body having a center point situated in a center of a mask body plane, a horizontal axis passing through the center of the mask body, horizontally extending along the mask body plane, a vertical axis passing through the center of the mask body, vertically extending along the mask body plane, and two diagonal axes passing through the center of the mask body, diagonally extending along the mask body plane, a vertical bridge part extending in the vertical direction being provided between the front-side openings of each two slots, of the multiple slots made in the mask body, that are arranged adjacently to each other in the horizontal direction, and between each first slot, of the multiple slots made in the mask body, that is situated at least on either of the diagonal axes of the mask body but in such a position that an angle at which electron beams enter the slot is 20 degrees or more and a second slot that is arranged adjacently to each first slot in the vertical direction, an extended part extending in the horizontal direction toward a peripheral side being provided so that the vertical bridge part recedes in the horizontal direction to peripheral side relative to the peripheral-side vertical outer edges of the front-side openings of the multiple slots.

6. The shadow mask according to claim 5, wherein the extended part satisfies:

$$0 < D3 < [T1 - 50]\ \mu m,$$

where D3 (μm) is a horizontal width of the extended part, and T1 (μm) is a distance between the peripheral-side vertical outer edge of the front-side opening, and a center-side, vertical outer edge of the front-side opening of each first slot situated horizontally adjacently to a third slot having a base front-side opening, on its peripheral side.

7. The shadow mask according to claim 5 that is a tension-type shadow mask to be stretched in the vertical direction during use.

* * * * *